US008991727B2

(12) United States Patent
Worthy et al.

(10) Patent No.: US 8,991,727 B2
(45) Date of Patent: Mar. 31, 2015

(54) MIST GENERATING APPARATUS AND METHOD

(75) Inventors: Jude Alexander Glynn Worthy, Huntingdon (GB); James Oliver French, Huntingdon (GB)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 1105 days.

(21) Appl. No.: 12/996,348

(22) PCT Filed: Jun. 4, 2009

(86) PCT No.: PCT/GB2009/050626

§ 371 (c)(1),
(2), (4) Date: Feb. 9, 2011

(87) PCT Pub. No.: WO2009/147443

PCT Pub. Date: Dec. 10, 2009

(65) Prior Publication Data

US 2011/0127347 A1 Jun. 2, 2011

(30) Foreign Application Priority Data

Jun. 4, 2008 (GB) ..... 0810155.2

(51) Int. Cl.
*A62C 5/00* (2006.01)
*A62C 31/00* (2006.01)
(Continued)

(52) U.S. Cl.
CPC ..... *B05B 7/0491* (2013.01); *B01F 5/0077* (2013.01); *B05B 7/0416* (2013.01);
(Continued)

(58) Field of Classification Search
CPC .. B05B 7/0408; B05B 7/0416; B05B 7/0433; B05B 7/0441; B05B 7/0458; B05B 7/0483; B05B 7/061; B05B 7/08; B05B 7/0807; A62C 5/02; A62C 5/022; A62C 5/024
USPC ..... 239/398, 433, 434, 434.5; 169/14, 15; 261/DIG. 26
See application file for complete search history.

(56) References Cited

U.S. PATENT DOCUMENTS 2,057,218 A * 10/1936 Timpson ..... 261/76
2,577,451 A * 12/1951 Clemens et al. ..... 169/15
(Continued)

FOREIGN PATENT DOCUMENTS

EP 855563 A1 * 7/1998
FR 474 904 A 3/1915
(Continued)

OTHER PUBLICATIONS

International Searching Authority, International Search Report and Written Opinion issued in International Application No. PCT/GB2009/050626, Nov. 27, 2009, 13 pages.
(Continued)

*Primary Examiner* — Melanie Tyson
*Assistant Examiner* — Thomas Berez
(74) *Attorney, Agent, or Firm* — Perkins Coie LLP

(57) ABSTRACT

An apparatus for generating a mist is provided. The apparatus has at least one working fluid supply conduit having an inlet in fluid communication with a supply of working fluid and an outlet in fluid communication with a first mixing chamber. The apparatus also includes a plurality of transport fluid passages, each of which has an inlet adapted to receive a supply of transport fluid and an outlet in fluid communication with the mixing chamber. Downstream of the mixing chamber is a nozzle having an inlet in fluid communication with the mixing chamber, an outlet, and a throat portion intermediate the nozzle inlet and outlet. The throat portion of the nozzle has a cross sectional area which is less than that of either the nozzle inlet or the nozzle outlet. The apparatus enhances the atomization of the working fluid to generate the mist.

5 Claims, 10 Drawing Sheets

(51) Int. Cl.

| | |
|---|---|
| ***B05B 7/04*** | (2006.01) |
| ***A62C 5/02*** | (2006.01) |
| ***A62C 35/00*** | (2006.01) |
| ***A62C 2/00*** | (2006.01) |
| ***A62C 3/00*** | (2006.01) |
| ***B01F 5/00*** | (2006.01) |
| *A62C 99/00* | (2010.01) |

(52) U.S. Cl.

CPC ..... *B01F5/0082* (2013.01); *A62C 5/008* (2013.01); *A62C 99/0072* (2013.01); *B05B 7/0433* (2013.01); *B05B 7/045* (2013.01)

USPC ..... 239/398; 239/433; 239/434; 239/434.5; 239/8; 169/14; 169/15; 169/46; 169/47

(56) References Cited

U.S. PATENT DOCUMENTS

| | | | | |
|---|---|---|---|---|
| 2,990,885 | A * | 7/1961 | Brazier | 169/44 |
| 4,014,961 | A | 3/1977 | Popov | |
| 5,014,790 | A * | 5/1991 | Papavergos | 169/44 |
| 5,113,945 | A * | 5/1992 | Cable | 169/15 |
| 5,129,583 | A * | 7/1992 | Bailey et al. | 239/427 |
| 5,445,226 | A * | 8/1995 | Scott et al. | 169/15 |
| 5,575,341 | A * | 11/1996 | Baker et al. | 169/70 |
| 5,810,252 | A * | 9/1998 | Pennamen et al. | 239/8 |
| 5,960,887 | A * | 10/1999 | Crabtree | 169/15 |
| 6,598,802 | B2 * | 7/2003 | Wolfe | 239/8 |
| 7,040,551 | B2 * | 5/2006 | Rummel | 239/135 |
| 2007/0210186 | A1 | 9/2007 | Fenton et al. | |
| 2008/0230632 | A1 | 9/2008 | Fenton et al. | |
| 2009/0314500 | A1 | 12/2009 | Fenton et al. | |
| 2010/0230119 | A1 | 9/2010 | Worthy et al. | |
| 2010/0301129 | A1 | 12/2010 | Fenton et al. | |
| 2011/0203813 | A1 | 8/2011 | Fenton et al. | |
| 2012/0018531 | A1 | 1/2012 | Fenton et al. | |

FOREIGN PATENT DOCUMENTS

| | | |
|---|---|---|
| JP | 59-216651 | 12/1984 |
| JP | 2001-149822 | 6/2001 |
| JP | 2001-327896 | 11/2001 |
| JP | 2002-079145 | 3/2002 |
| JP | 2003-220354 | 8/2003 |
| JP | 2007-073615 | 3/2007 |
| JP | 2007-283220 | 11/2007 |
| JP | 2008-023459 | 2/2008 |
| JP | 2008-055414 | 3/2008 |
| WO | WO 01/36105 A1 | 5/2001 |
| WO | WO 01/76764 | 10/2001 |

OTHER PUBLICATIONS

International Searching Authority, International Preliminary Report on Patentability issued in International Application No. PCT/GB2009/050626, Dec. 16, 2010, 11 pages.

European Application No. 09757815.7.

Australian Application No. 2009254940.

Examination Report and English Translation issued in related co-pending Japanese Application No. 2011-512225, Jul. 16, 2013,11 pages.

Examination Report and English Translation issued in related co-pending Chinese Application No. 200980130525.4, Oct. 28, 2013, 8 pages.

* cited by examiner

MIST GENERATING APPARATUS AND METHOD

This application is a U.S. National Stage Application of International Application No. PCT/GB2009/050626, which was filed on Jun. 4, 2009, and which claims priority to Great Britain Application No. 0810155.2, which was filed on Jun. 4, 2008, all of which are incorporated by reference in their entireties as if recited in full herein.

The present invention provides an improved apparatus and method for generating mists of very small droplets, which have been shown to be beneficial in a number of diverse fields. Examples of such fields include cooling, fire suppression and decontamination applications.

WO01/76764 discloses a mist generating apparatus which uses two fluids, primarily for use in fire suppression. In WO '764 an aerosol of first fluid droplets (i.e. droplets of a first fluid carried in a gaseous medium) is passed through a number of first fluid nozzles into a mixing zone. At the same time, a stream of gas is injected into the mixing zone upstream of the first fluid nozzles. The gas carries the first fluid droplets through an outlet nozzle which sprays the combined stream of first fluid droplets and second fluid from the apparatus. The purpose of WO '764 is to reduce the frictional forces which act on the droplets when they are sprayed into the atmosphere by carrying the droplets out of the nozzle on the gas stream.

WO '764 only uses the gas stream to carry the droplets out of the nozzle. The aerosol of first fluid droplets is created at an undisclosed location upstream of the WO '764 apparatus, and the apparatus itself does not apply any mechanism to further atomise the droplets of the first fluid in the aerosol. Consequently, the aerosol created upstream of the WO'764 apparatus dictates the size of the droplets sprayed from the apparatus, with the apparatus itself having no effect on the droplet size. A further limitation of the WO'764 apparatus is that it is difficult to achieve a homogenous mixture of droplets and gas. The first embodiment disclosed in WO '764 relies on a single, annular stream of gas which is positioned radially outward of the first fluid passage and nozzles. This arrangement makes it highly unlikely that an effective distribution of first fluid droplets in the gas will be achieved. Such limitations make unpredictable variations in droplet size and distribution very likely with the arrangement shown in WO '764.

It is an aim of the present invention to obviate or mitigate these and other disadvantages with the prior art.

According to a first aspect of the present invention, there is provided an apparatus for generating a mist, comprising:

- at least one working fluid supply conduit having an inlet in fluid communication with a supply of working fluid and an outlet;
- a first mixing chamber being in fluid communication with the working fluid supply conduit outlet;
- a plurality of transport fluid passages, each transport fluid passage having an inlet adapted to receive a supply of transport fluid and an outlet in fluid communication with the mixing chamber; and
- a nozzle having an inlet in fluid communication with the mixing chamber, an outlet, and a throat portion intermediate the nozzle inlet and outlet, the throat portion having a cross sectional area which is less than that of either the nozzle inlet or the nozzle outlet.

The apparatus may further comprise at least one working fluid passage intermediate the working fluid supply conduit and the mixing chamber, wherein the working fluid passage has an inlet in fluid communication with the supply conduit and a diameter which is less than that of the supply conduit.

The apparatus has a longitudinal axis, and at least one of the transport fluid passage outlets may be positioned a shorter radial distance from the longitudinal axis than the working fluid passage outlet.

The plurality of transport fluid passages may comprise an inner transport fluid passage co-axial with the longitudinal axis, and a plurality of outer transport fluid passages circumferentially spaced about the inner transport fluid passage.

The apparatus may comprise a plurality of working fluid passages, wherein the working fluid and transport fluid passages alternate circumferentially about the longitudinal axis of the apparatus.

The apparatus may comprise a plurality of working fluid passages, wherein the working fluid passages are circumferentially spaced about the inner transport fluid passage. The working fluid passages may be radially positioned between the inner transport fluid passage and the outer transport fluid passages. Alternatively, each of the working fluid passages may be located between a pair of the outer transport fluid passages, whereby the working fluid and outer transport fluid passages alternate circumferentially about the inner transport fluid passage.

The plurality of working fluid passages may comprise inner and outer working fluid passages, wherein the groups of inner and outer working fluid passages are both circumferentially spaced about the inner transport fluid passage, the outer working fluid passages being a greater radial distance from the inner transport fluid passage than the inner working fluid passages.

The working fluid and transport fluid passages may be substantially parallel to one another.

The at least one working fluid passage is substantially parallel to the longitudinal axis of the apparatus.

The working fluid supply conduit and the working fluid passage may be substantially perpendicular to one another.

The apparatus may further comprise a second mixing chamber intermediate the working fluid supply conduit and the first mixing chamber, wherein at least one of the transport fluid passages is in fluid communication with the second mixing chamber whilst the remainder of the transport fluid passages are in fluid communication with the first mixing chamber.

The apparatus may further comprise a communicating passageway between the first and second mixing chambers, the passageway having a cross sectional area which is less than that of either mixing chamber.

According to a second aspect of the present invention, there is provided an apparatus for generating a mist comprising:

- a body having a first end in which a working fluid inlet and a transport fluid inlet are defined and a second end in which a compartment is defined, the compartment having a first end in fluid communication with the working and transport fluid inlets and a second end which is open;
- a first insert adapted to be received within the open end of the compartment, the first insert defining at least one working fluid supply conduit in fluid communication with the working fluid inlet, and a plurality of transport fluid passages in fluid communication with the transport fluid inlet;
- a second insert adapted to be received in the compartment between the first insert and the open end of the compartment, wherein the second insert defines a nozzle having a throat portion of reduced cross sectional area, and wherein the first and second inserts define a first mixing chamber between them which is intermediate the working and transport fluid passages and the nozzle; and a locking member adapted to be received on the second insert and the second end of the body so as to secure the first and second inserts in the compartment.

The first insert may further comprise at least one working fluid passage intermediate the working fluid supply conduit and the first mixing chamber, the working fluid passage having an inlet in fluid communication with the supply conduit and having a diameter which is less than that of the supply conduit.

The apparatus and first insert are co-axial about a longitudinal axis, and at least one of the transport fluid passage outlets defined in the first insert may be positioned a shorter radial distance from the longitudinal axis than the working fluid passage outlet.

The plurality of transport fluid passages defined in the first insert may comprise an inner transport fluid passage co-axial with the longitudinal axis, and a plurality of outer transport fluid passages circumferentially spaced about the inner transport fluid passage.

The first insert may define a plurality of working fluid passages, wherein the working fluid and transport fluid passages alternate circumferentially about the longitudinal axis of the first insert.

The first insert may define a plurality of working fluid passages, wherein the working fluid passages are circumferentially spaced about the inner transport fluid passage. The working fluid passages may be radially positioned between the inner transport fluid passage and the outer transport fluid passages. Alternatively, each of the working fluid passages may be located between a pair of the outer transport fluid passages, whereby the working fluid and outer transport fluid passages alternate circumferentially about the inner transport fluid passage.

The plurality of working fluid passages may comprise inner and outer working fluid passages, wherein the groups of inner and outer working fluid passages are both circumferentially spaced about the inner transport fluid passage, the outer working fluid passages being a greater radial distance from the inner transport fluid passage than the inner working fluid passages.

The working fluid and transport fluid passages defined by the first insert may be substantially parallel to one another.

The at least one working fluid passage is substantially parallel to the longitudinal axis of the first insert.

The working fluid supply conduit and the working fluid passage may be substantially perpendicular to one another.

The first insert may further comprise a second mixing chamber intermediate the working fluid supply conduit and the first mixing chamber, wherein at least one of the transport fluid passages is in fluid communication with the second mixing chamber whilst the remainder of the transport fluid passages are in fluid communication with the first mixing chamber.

The apparatus may further comprise a communicating passageway between the first and second mixing chambers, the passageway having a cross sectional area which is less than that of either mixing chamber.

According to a third aspect of the present invention, there is provided a method of generating a mist, comprising the steps of:

supplying a pressurised working fluid to at least one working fluid supply conduit;

introducing a supply of transport fluid through a plurality of transport fluid passages into a first mixing chamber downstream of the working fluid supply conduit;

atomising the working fluid by injecting a stream of working fluid from the working fluid supply conduit into the first mixing chamber to form a dispersed phase of working fluid droplets;

directing the transport fluid and dispersed phase of working fluid from the first mixing chamber through a nozzle throat portion having a reduced cross sectional area; and spraying the transport fluid and dispersed phase of working fluid from a nozzle outlet having a greater cross sectional area than the nozzle throat.

The mixing chamber has a longitudinal axis, and a portion of the transport fluid may be introduced into the mixing chamber at a position which is a smaller radial distance from the longitudinal axis than that at which the working fluid is introduced.

A portion of the transport fluid may be introduced into the mixing chamber via an inner transport fluid passage which is co-axial with the longitudinal axis, and the remainder of the transport fluid may be introduced via a plurality of outer transport fluid passages circumferentially spaced about the inner transport fluid passage.

The working fluid may be atomised by passing the working fluid through a plurality of working fluid passages which alternate circumferentially with the plurality of transport fluid passages about the longitudinal axis.

The working fluid may be atomised by passing the working fluid through a plurality of working fluid passages which are circumferentially spaced about the inner transport fluid passage. The working fluid passages may be radially positioned between the inner transport fluid passage and the outer transport fluid passages. Alternatively, each working fluid passage may be positioned between a pair of outer transport fluid passages, whereby the working fluid and outer transport fluid passages alternate circumferentially about the inner transport fluid passage.

According to a fourth aspect of the present invention, there is provided an apparatus for generating a mist, comprising:

at least one working fluid supply conduit having an inlet in fluid communication with a supply of working fluid and an outlet;

at least one transport fluid supply conduit having an inlet in fluid communication with a supply of transport fluid and an outlet;

a first mixing chamber being in fluid communication with the respective outlets of the working and transport fluid supply conduits;

a second mixing chamber being in fluid communication with the first mixing chamber;

a plurality of communicating passages connecting the first and second mixing chambers; and a nozzle having an inlet in fluid communication with the second mixing chamber, an outlet, and a throat portion intermediate the nozzle inlet and outlet, the throat portion having a cross sectional area which is less than that of either the nozzle inlet or the nozzle outlet.

The apparatus may further comprise at least one working fluid passage intermediate the working fluid supply conduit and the first mixing chamber, wherein the working fluid passage has an inlet in fluid communication with the supply conduit and a diameter which is less than that of the supply conduit.

The at least one working fluid passage and transport fluid supply conduit communicate with the first mixing chamber from substantially opposite directions.

The plurality of communicating passages may comprise an inner communicating passage co-axial with the longitudinal axis, and a plurality of outer communicating passages circumferentially spaced about the inner communicating passage.

A preferred embodiment of the present invention will now be described, by way of example only, with reference to the accompanying drawings, in which:

FIG. 1 is a longitudinal section through a body or housing of a mist generating apparatus;

FIGS. 2(*a*)-(*c*) are first end, longitudinal section, and second end views of a first insert of a mist generating apparatus;

A mist generating apparatus is generally designated 10 and is made up of four main components, which are illustrated in FIGS. 1-4.

Figure 1:
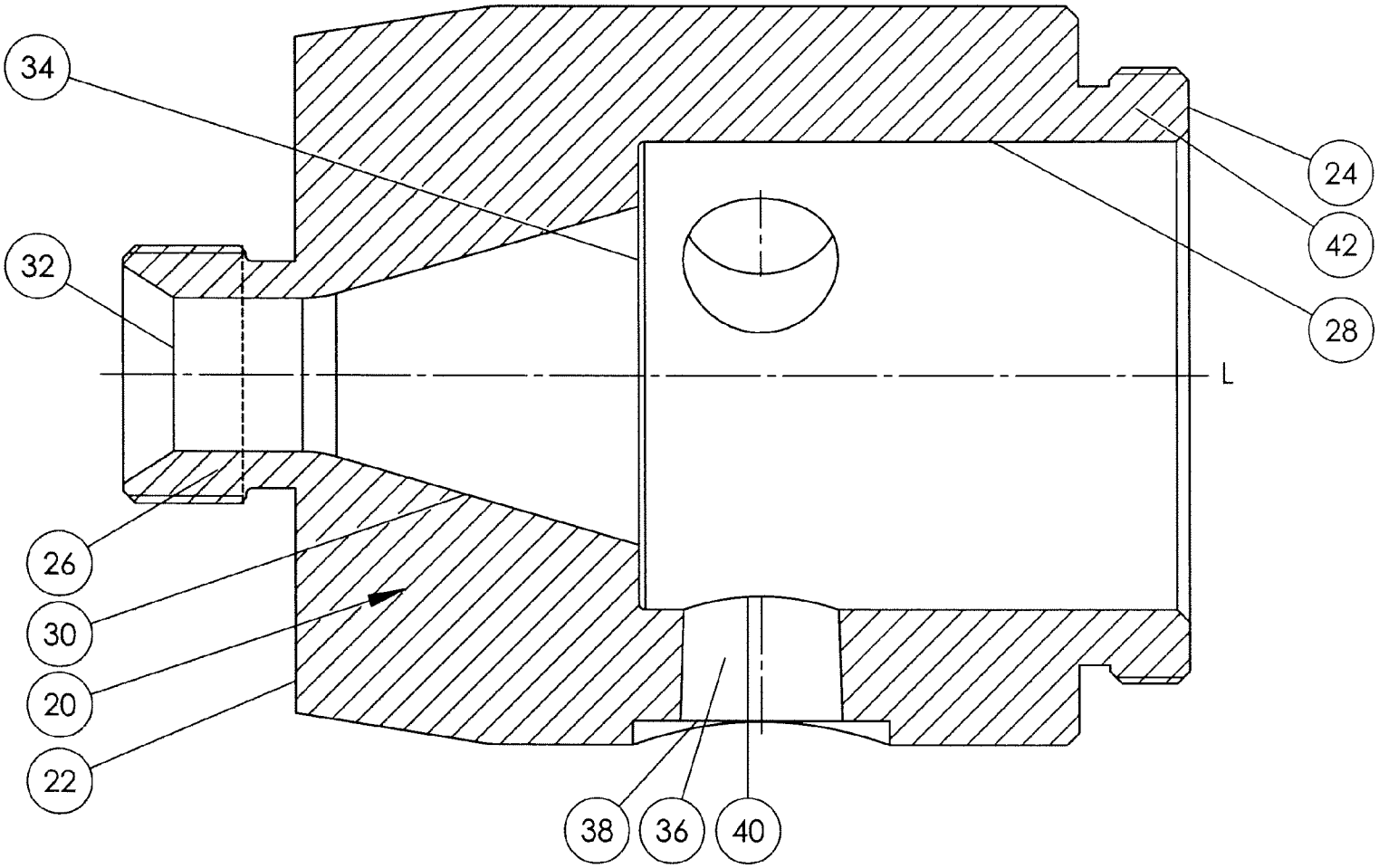

The first component as shown in FIG. 1 is a generally cylindrical body or housing 20 having first and second ends 22,24. A neck portion 26 projects longitudinally from the first end 22 of the body 20. At the second end 24 of the body is a compartment 28 which is open at the second end 24 of the body 20 and adapted to receive other components of the apparatus 10, as will be described below. Extending longitudinally through the body 20 is a first supply conduit, or transport fluid supply conduit, 30. The transport fluid supply conduit 30 has an inlet 32 in the neck portion 26, and an outlet 34 which opens into the compartment 28. The transport fluid supply conduit 30 has a diverging profile, where the cross sectional area of the conduit 30 increases as it extends through the body 20 from the inlet 32 towards the outlet 34. A second supply conduit, or working fluid supply conduit, 36 is also provided in the body 20 and extends through a side wall of the body 20. The working fluid supply conduit 36 has an inlet 38 on the exterior of the body 20 and an outlet 40 which opens into the compartment 28. Thus, the transport and working fluid supply conduits 30,36 are substantially perpendicular to one another. The neck portion 26 and/or the inlet 32 are adapted so they can be connected to a source of transport fluid (not shown), while the working fluid inlet 38 is adapted so that it may be connected to a source of working fluid (not shown). The second end 24 of the body 20 has a projecting lip portion 42 of reduced outside diameter, where at least a part of the outer surface of the lip portion 42 is provided with a thread (not shown).

Figure 2:
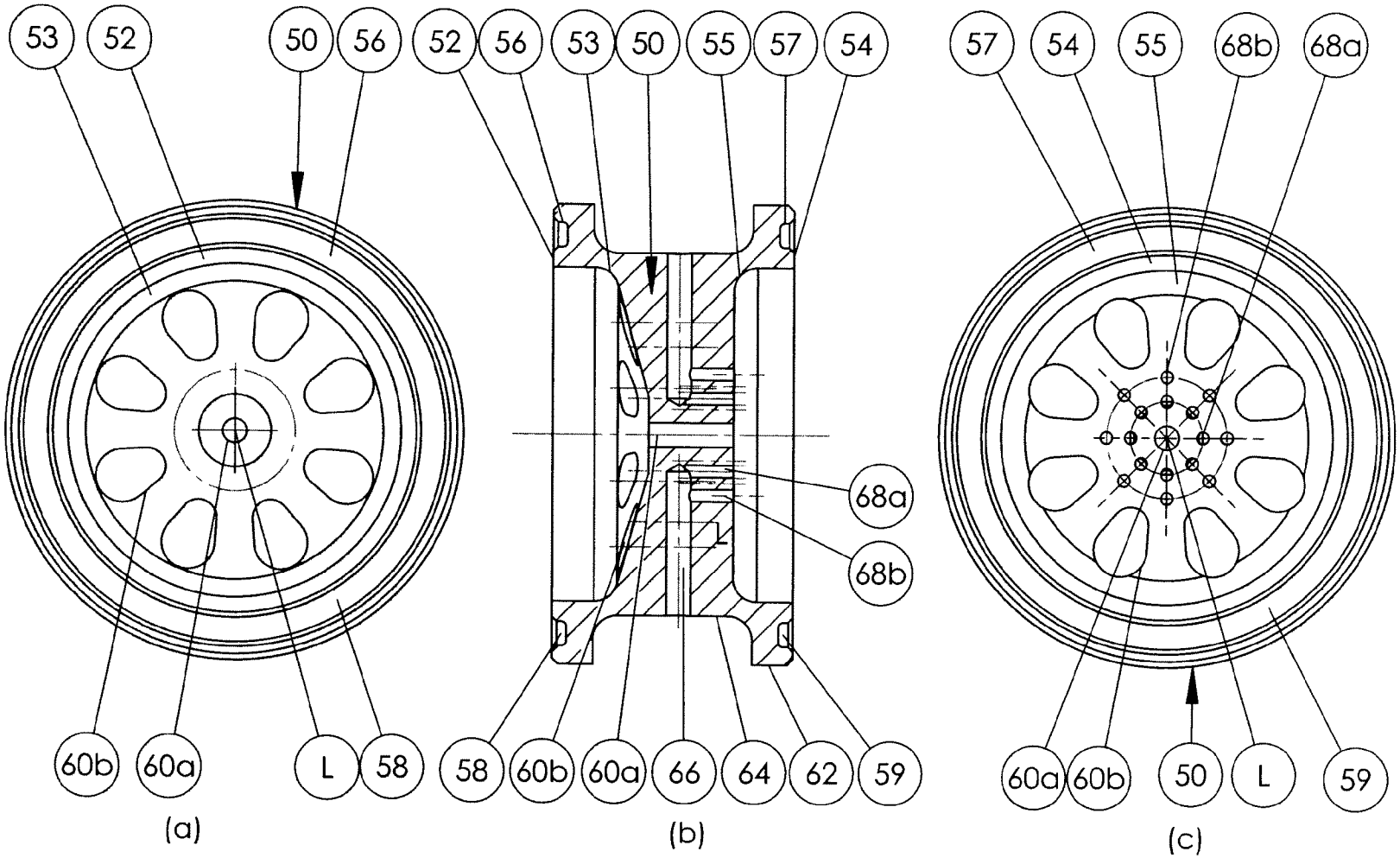
Figure 3:
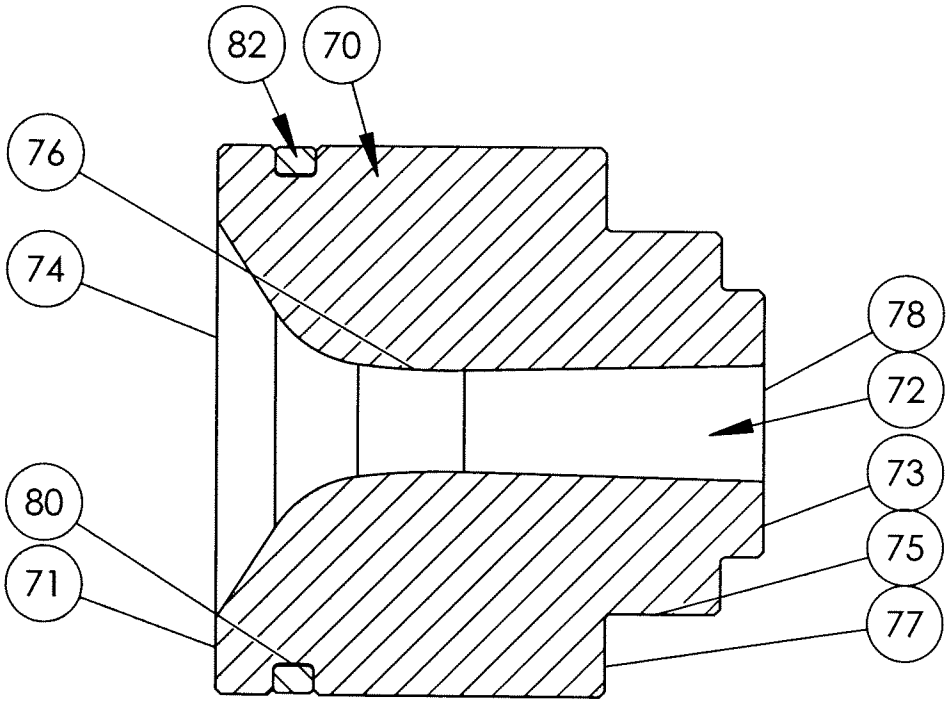
FIG. 3 is a longitudinal section through a second insert of a mist generating apparatus.

Two other components forming part of the apparatus are a first, or fluid distribution, insert 50 and a second, or nozzle, insert 70, which are shown 15 in FIGS. 2 and 3 respectively and are adapted to be located within the compartment 28 of the body 20. Referring to FIGS. 2(*a*)-(*c*), the first insert 50 is a generally cylindrical insert which is L-shaped when viewed in a vertical section, as clearly seen in FIG. 2(*b*). In other words, the first insert 50 is thickest at its outer 20 periphery with the central portion of the insert 50 having a reduced thickness by comparison. The insert 50 has a first end face 52 and a second end face 54, each of which can be seen in the respective views of FIGS. 2(*a*) and 2(*c*). Each of the end faces 52,54 of the insert 50 has an annular groove 56,57 extending about the circumference of the outer 25 periphery of the insert 50. Located in each of the annular grooves 56,57 is an O-ring seal 58,59.

Because the insert 50 has an I-shape when viewed in a vertical section, the first and second end faces 52,54 of the insert 50 have first and second concave cavities 53,55, respectively, formed therein. Extending longitudinally through the insert 50 and fluidly connecting the first and second cavities 53,55 are a plurality of first passages, or transport fluid passages, 60*a*,60*b*. An inner first passage 60*a* is located in the centre of the insert 50 such that it is co-axial with a longitudinal axis L shared by the insert 50 and the assembled apparatus 10. The outer first passages 60*b* are circumferentially spaced about, and substantially parallel with, the inner first passage 60*a* and the longitudinal axis L.

The insert 50 also has an outer circumferential surface 62 in which a channel 64 is formed. The channel 64 extends around the entire circumference of the insert 50. Extending radially inwards through the insert 50 from the channel 64 are a plurality of working fluid supply conduits 66. The supply conduits 66 are substantially perpendicular to the first passages 60 and longitudinal axis L. The supply conduits 66 extend radially inwards through the insert 50 in the circumferential spaces provided between the outer first passages 60*b*. The supply conduits 66 allow fluid communication between the channel 64 and a plurality of second passages, or working fluid passages, 68*a*,68*b* located at the radially innermost end of the conduits 66. The second passages are divided into two groups whereby there are a plurality of inner second passages 68*a* and a plurality of outer second passages 68*b*. Each of the second passages 68*a*,68*b* is substantially parallel with the longitudinal axis L and the first fluid passages 60*a*, 60*b* and thus substantially perpendicular to the supply conduits 66. The second passages 68*a*,68*b* have a substantially constant diameter which may be less than that of the supply conduits 66. The inner and outer second passages 68*a*,68*b* are circumferentially spaced about the inner first passage 60*a* and axis L, with the outer second passages 68*b* being located radially outwards of the inner second passages 68*a*. The second passages 68*a*,68*b* are substantially parallel to the longitudinal axis L, as well as the first passages 60*a*,60*b*.

The relative radial and circumferential positions of each of the first and second passages can be best seen in FIG. 2(*c*). From FIG. 2(*c*), it can be seen that the second passages 68*a*,68*b* are radially and circumferentially spaced so as to surround the inner first passage 60*a*, whilst the outer first passages 60*b* are radially and circumferentially spaced so as to surround the second passages 68*a*,68*b*.

The second nozzle insert 70 can be seen in FIG. 3. As with the first insert 50, the second insert 70 is generally cylindrical and is co-axial with the remaining components of the apparatus 10. The second insert 70 has a nozzle 72 defined therein, the nozzle 72 having a nozzle inlet 74, a throat portion 76 and a nozzle outlet 78. The nozzle 72 is co-axial with the axis L, and the throat portion 76 intermediate the nozzle inlet 74 and nozzle outlet 78 has a cross sectional area which is less than that of either the nozzle inlet 74 or the nozzle outlet 78. It can also be seen clearly from FIG. 3 that the reduction and subsequent increase in cross sectional area through the nozzle 72 maintains a continuously varying external wall in the nozzle 72. In other words, the nozzle 72 does not include any sudden step changes in cross sectional area, which would create steps or niches in the nozzle wall which would interfere with the fluid flow therethrough. The nozzle 72 is therefore a genuine convergent-divergent nozzle as is understood in the art as being suitable for generating supersonic flow therethrough.

The nozzle insert 70 has first and second ends having a first end face 71 and a second end face 73, respectively. A groove 80 is located in the outer circumferential surface of the insert 70 adjacent the first end. The groove 80 extends around the entire circumference of the insert 70 and an O-ring seal 82 is located in the groove 80. The nozzle insert 70 has a reduced diameter portion 75 adjacent the second end. The variation between the standard diameter of the insert 70 and the reduced diameter portion 75 creates an abutment face 77, which faces in the direction of the second end of the insert 70.

Figure 4:
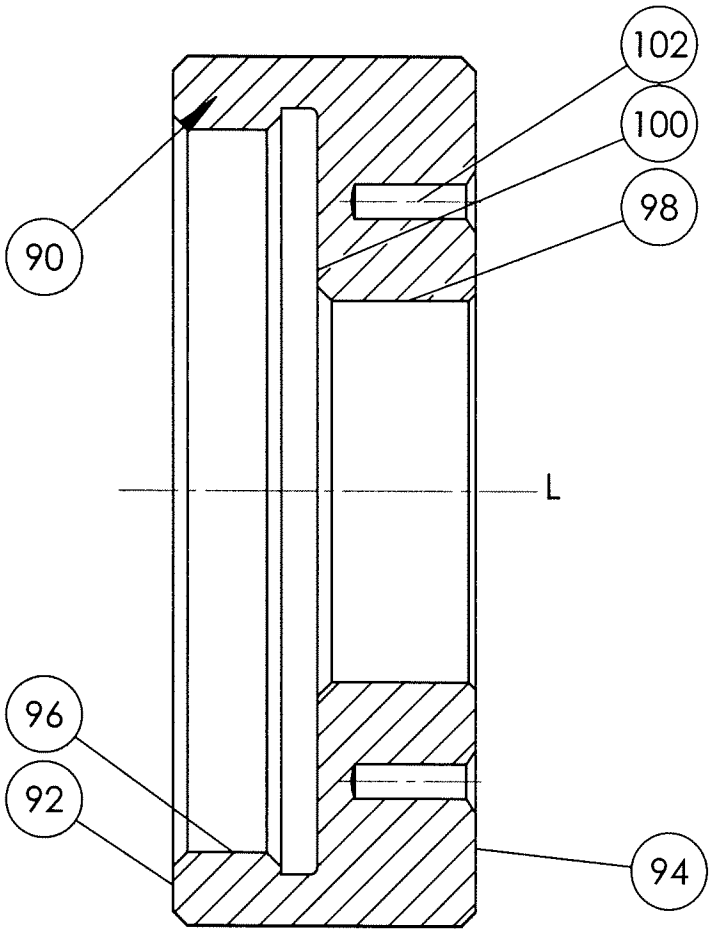
FIG. 4 is a longitudinal section through a locking member of a mist generating apparatus.

The final component of the apparatus 10 is a locking member 90, which is shown in FIG. 4. The locking member 90 is preferably in the form of a ring which has a first side face 92 and a second side face 94. The locking member 90 has a bore passing through it which is formed from first and second portions 96,98. The first bore portion 96 opens on the first side face 92 whilst the second bore portion 98 opens on the second side face 94. The first bore portion 96 has a greater diameter than the second bore portion 98. The variation in diameter between the first and second bore portions 96,98 creates an abutment face 100, which faces in the direction of the first side face 92 of the locking member 90. At least a part of the internal surface of the first bore portion 96 is provided with a thread (not shown). The second end 94 of the locking member 90 can be provided with one or more apertures 102 adapted to receive a suitable tool for securing the locking member 90 to the remainder of the apparatus 10.

Figure 5:
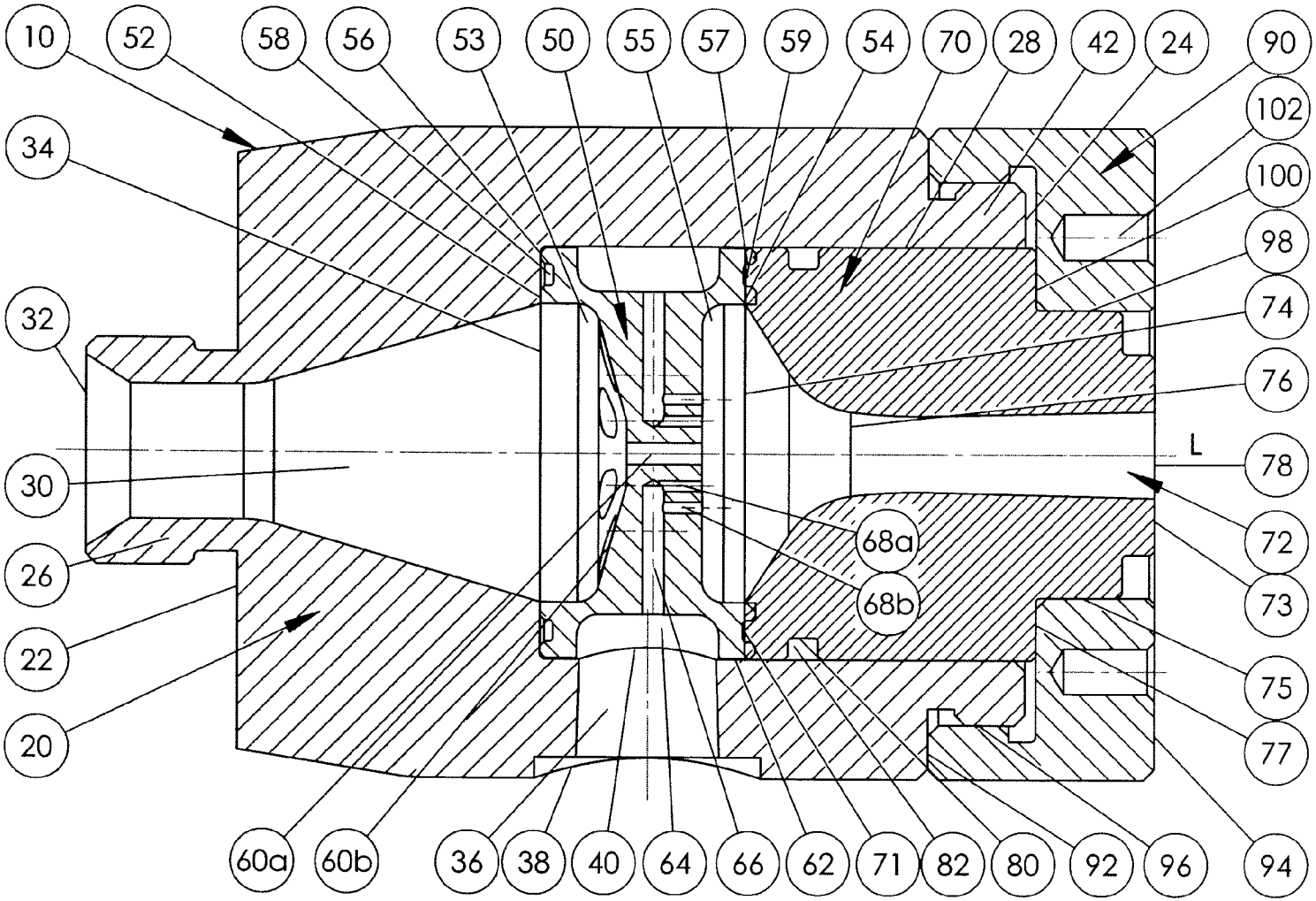
FIG. 5 is a longitudinal section through a first embodiment of a mist generating apparatus incorporating the components shown in FIGS. 1-4.

Referring now to FIG. 5, the various components of the apparatus 10 as described above are assembled in the following manner. Firstly, the fluid distribution insert 50 is slid into the compartment 28 via the second end 24 of the body 20. The internal diameter of the compartment 28 and the external diameter of the insert 50 are such that a close, sealing fit is achieved between the insert 50 and the body 20. When the insert 50 is correctly positioned within the compartment 28, the first end face 52 of the insert abuts the outlet 34 of the transport fluid supply conduit 30 in the body 20. As a result, the outlet 34 of the transport fluid supply conduit 30 is in fluid communication with the first cavity 53 of the insert 50, and the second fluid supply conduit 36 is in fluid communication with the channel 64 of the insert 50. The O-ring seal 58 provides a sealing fit between the first insert 50 and the body 20.

Once the first insert is in position, the second insert 70 can be inserted into the compartment 28 via the second end 24 of the body 20. As with the first insert 50, the internal diameter of the compartment 28 and the external diameter of the second insert 70 are such that a close, sealing fit is achieved between the insert 70 and the body 20. When the second insert 70 is correctly positioned within the compartment 28, the first end face 71 of the second insert 70 abuts the second end face 54 of the first insert 50. As a result, a mixing chamber sharing the longitudinal axis L is defined by the nozzle inlet 74 of the second insert 70 and the second cavity 55 of the first insert 50. Consequently, the body 20, first insert 50 and second insert 70 are now all in fluid communication with one another via the previously described cavities, passages and conduits defined within these components, as will be described in further detail below. The second of the O-ring seals 59 located in the second end face 54 of the first insert 50 provides a sealing fit between the first and second inserts 50,70.

Finally, once the first and second inserts 50,70 are located in their correct positions in the compartment 28 of the body 20, the locking member 90 can be placed over the second end of the second insert 70. The threaded portions of the lip 42 of the body 20 and the first side face 92 of the locking member 90 cooperate with one another so that the locking member 90 can be screwed into position by way of a tool (not shown) inserted into the apertures 102 in the locking member 90. The locking member 90 is screwed onto the body 20 until the respective abutment faces 77,100 of the second insert 70 and the locking member 90 come up against one another. Once this has taken place, the first and second inserts 50,70 are firmly held in position, sandwiched between the body 20 and the locking member 90.

The manner in which the apparatus 10 operates can now be described, again with particular reference to FIG. 5. Initially, a transport fluid is introduced from a suitable source (e.g. a bottle of compressed gas) into the transport fluid supply inlet 32. There are a variety of fluids which would be suitable for use as the transport fluid, but in this preferred example the transport fluid is air. The supply pressure of the transport fluid may be in the range 2 to 40 bar, or more preferably in the range 5 to 20 bar. The transport fluid passes along the transport fluid supply conduit 30 into the first cavity 53 defined in the first insert 50. Once in the first cavity 53, the transport fluid separates into a 60*a*,60*b* provided in the first insert 50. As the transport fluid flows leave the first fluid passages 60*a*,60*b* they enter the mixing chamber defined between the second cavity 55 of the first insert 50 and the nozzle inlet 74 of the second insert 70. The various transport fluid flows expand and come into contact with one another in the mixing chamber, thereby creating a turbulent zone in the mixing chamber. The transport fluid enters the mixing chamber under high pressure but with a relatively low velocity.

At the same time as the transport fluid is being introduced into the transport fluid supply conduit 30, a working fluid is being introduced from a suitable source at a preferred supply pressure in the range 2 to 40 bar, most preferably in the range 5 to 20 bar. The working fluid is introduced into the working fluid supply conduit 36 provided in the body 20. As with the transport fluid, the working fluid can be a number of fluids but in this preferred example is water. As the working fluid passes through the working fluid supply conduit 36, it enters the channel 64 provided in the exterior of the first insert 50. The working fluid can then flow around the entire circumference of the first insert 50 via the channel 64, which lies between the body 20 and the first insert 50. As it flows around the channel 64, the working fluid enters the plurality of radial supply conduits 66 in the first insert 50 and flows inwards towards the longitudinal axis L of the apparatus. At the inner ends of the supply conduits 66, the working fluid turns through 90 degrees and enters the inner and outer second fluid passages 68*a*,68*b*. This 90 degree turn destabilises the working fluid, increasing the level of turbulence therein and enhancing the atomisation of the working fluid in the mixing chamber, which will be further described below.

The transport and working fluids can be supplied over a large range of mass flow rates. The ratio between the mass flow rates of transport and working fluid may vary over a preferred range from 20:1 to 1:10.

Once the working fluid reaches the outlets of the second fluid passages 68*a*,68*b*, a stream of working fluid is injected from each second passage 68*a*,68*b* into the mixing chamber. As the injected working fluid streams come into contact with the ambient gas in the mixing chamber, frictional forces between the two lead to the atomisation of the working fluid streams, thereby forming droplets of working fluid. The turbulence generated by the transport fluid entering the mixing chamber ensures that the droplets created by this atomisation of the working fluid are spread throughout the mixing chamber. This is the first stage of the atomisation mechanism employed by the present invention.

The remaining stages of the atomisation mechanism occur in the nozzle 72 of the apparatus 10. The working fluid droplets in the mixing chamber are carried by the turbulent transport fluid into the nozzle inlet 74. The gradual reduction in cross sectional area between the nozzle inlet 74 and the nozzle throat 76 leads to an acceleration of the transport fluid to a very high, preferably sonic, velocity. This acceleration of the transport fluid means that there is a velocity gradient across the droplets of working fluid in the convergent region of the nozzle (ie. the region between the nozzle inlet and the nozzle throat), as the portion of each droplet closest to the nozzle throat will be travelling faster than the portion closest to the nozzle inlet. This subjects the working fluid droplets to shear forces and leads to them stretching or elongating in the direction of flow. When the shear forces exceed the surface tension forces a further atomisation occurs as the droplets deform and break up into smaller droplets. This shearing action is the second stage of the atomisation mechanism.

The reduced size working fluid droplets leave the nozzle throat 76 at very high, and possibly sonic, velocity. As previously described, the nozzle outlet 78 has a greater cross sectional area than the nozzle throat 76. Consequently, the high velocity transport fluid undergoes an expansion as it flows from the throat portion 76 towards the outlet 78. This stretches the working fluid droplets contained in the transport fluid and causes them to break up into a number of smaller working fluid droplets. This tearing of the droplets is the third stage in the atomisation mechanism employed by the present invention.

Finally, the droplets are sprayed from the nozzle outlet 78 in a dispersed phase as a mist. Depending on the operating conditions, the flow through the nozzle 72 may be subsonic in the region between the throat portion 76 and the nozzle outlet 78. Alternatively, the operating conditions may mean that the flow in this region may be supersonic along some or all of its length, with the supersonic region terminating in a shock wave either between the throat portion 76 and the nozzle outlet 78, at the nozzle outlet 78, or external to the apparatus 10. In those operating conditions at which a shock wave occurs, it may provide a fourth droplet breakup mechanism due to the sudden pressure rise across the shockwave.

Figure 10:
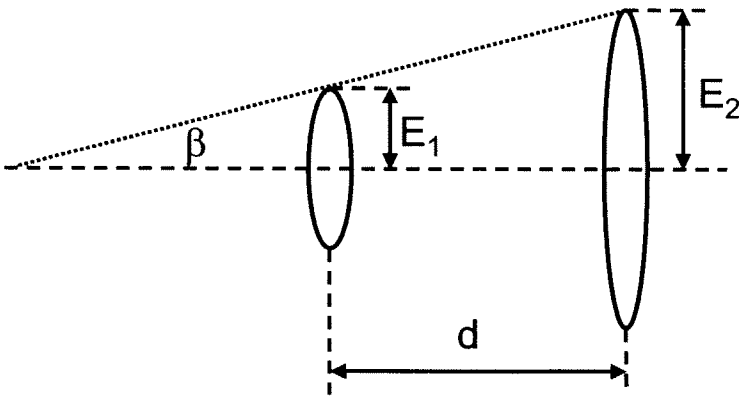
FIG. 10 is a schematic illustrating an equivalent angle of expansion for the nozzle used in the various embodiments of the mist generating apparatus.

FIG. 10 shows schematically how an equivalent angle of expansion for the nozzle 72 can be calculated when the cross sectional areas of the throat and outlet, and the equivalent path distance between the throat and outlet are known. E1 is the radius of a circle having the same cross sectional area as the nozzle throat 76. E2 is the radius of a circle having the same cross sectional area as the nozzle outlet 78. The distance d is the equivalent path distance between the throat 76 and the outlet 78. An angle β is calculated by drawing a line through the top of E2 and E1 which intersects a continuation of the equivalent distance line d. This angle β can either be measured from a scale drawing or else calculated from trigonometry using the radii E1, E2 and the distance d. The equivalent angle of expansion γ for the second fluid passage can then be calculated by multiplying the angle β by a factor of two, where $\gamma=2\beta$.

For optimum performance of the apparatus 10, it has been found that the cross sectional area at the outlet 78 of the nozzle 72 may be between 1.1 and 28 times larger than that of the throat portion 76, such that the area ratio between the throat 76 and outlet 78 of the nozzle 72 may be between 1:1.1 and 1:28. The cross sectional area at the outlet 78 of the nozzle 72 may most preferably be between 1.4 and 5.5 times larger than that of the throat portion 76, such that the area ratio between the throat 76 and outlet 78 of the nozzle 72 is therefore most preferably between 5:7 and 2:11. This increase in cross sectional area between the throat 76 and outlet 78 creates an equivalent included angle of expansion γ for the nozzle 72 of between 1 and 40 degrees, and an angle γ which is most preferably between 2 and 13 degrees.

Performance data obtained in tests of the apparatus shown in FIG. 5 is presented in Table 1 below. The results were obtained using a laser diffraction particle size system which measures the droplet sizes and performs the data analysis. The data was measured 3 m from the nozzle in the centre of the plume as this allowed good particle observation with the measurement system, but also represented typical plume characteristics for the nozzle. Having determined the droplet sizes present in the plume, the data was further analysed to calculate the $D_v90$ and $D_f90$, which are common measurement parameters used in industry. The $D_v90$ is the value where 90 percent of the total volume of the liquid sprayed is made up of drops with diameters smaller than or equal to this value. The $D_f90$ is the value where 90 percent of the total number of droplets sprayed have diameters smaller than or equal to this value.

In this non-limiting test example the transport fluid utilised was compressed air and the working fluid utilised was water.

TABLE 1

| Mass flow rate, ratio of gas:liquid | Pressure supply, ratio of gas:liquid | $D_v90$ [μm] | $D_f90$ [μm] |
|---|---|---|---|
| 1:4 | 1:0.875 | 180 | 4 |
| 1:8 | 1:0.875 | 220 | 2.5 |
| 1:14 | 1:0.861 | 255 | 2.5 |

Figure 6:
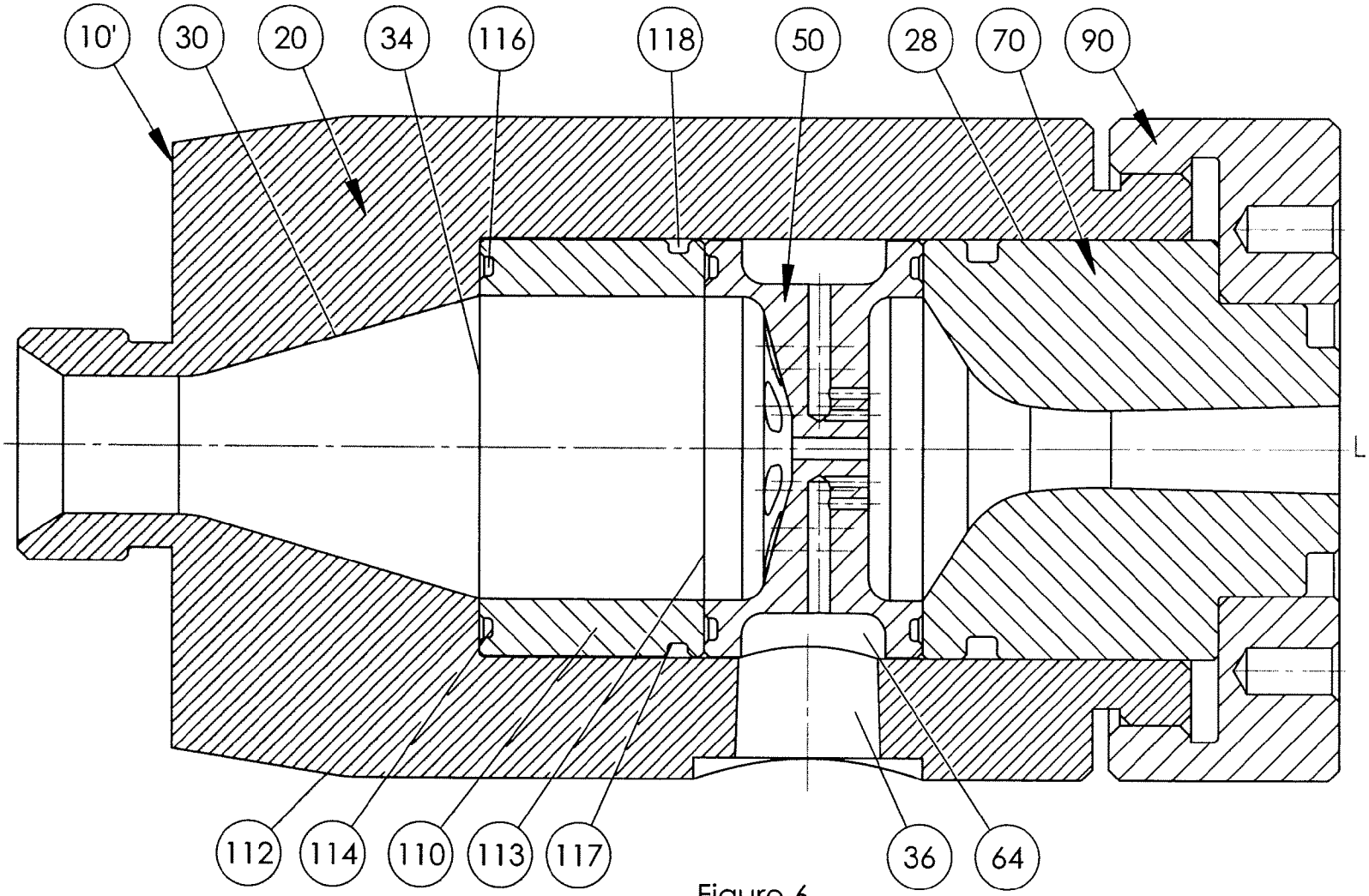
FIG. 6 is a longitudinal section through a second embodiment of a mist generating apparatus.
Figure 7:
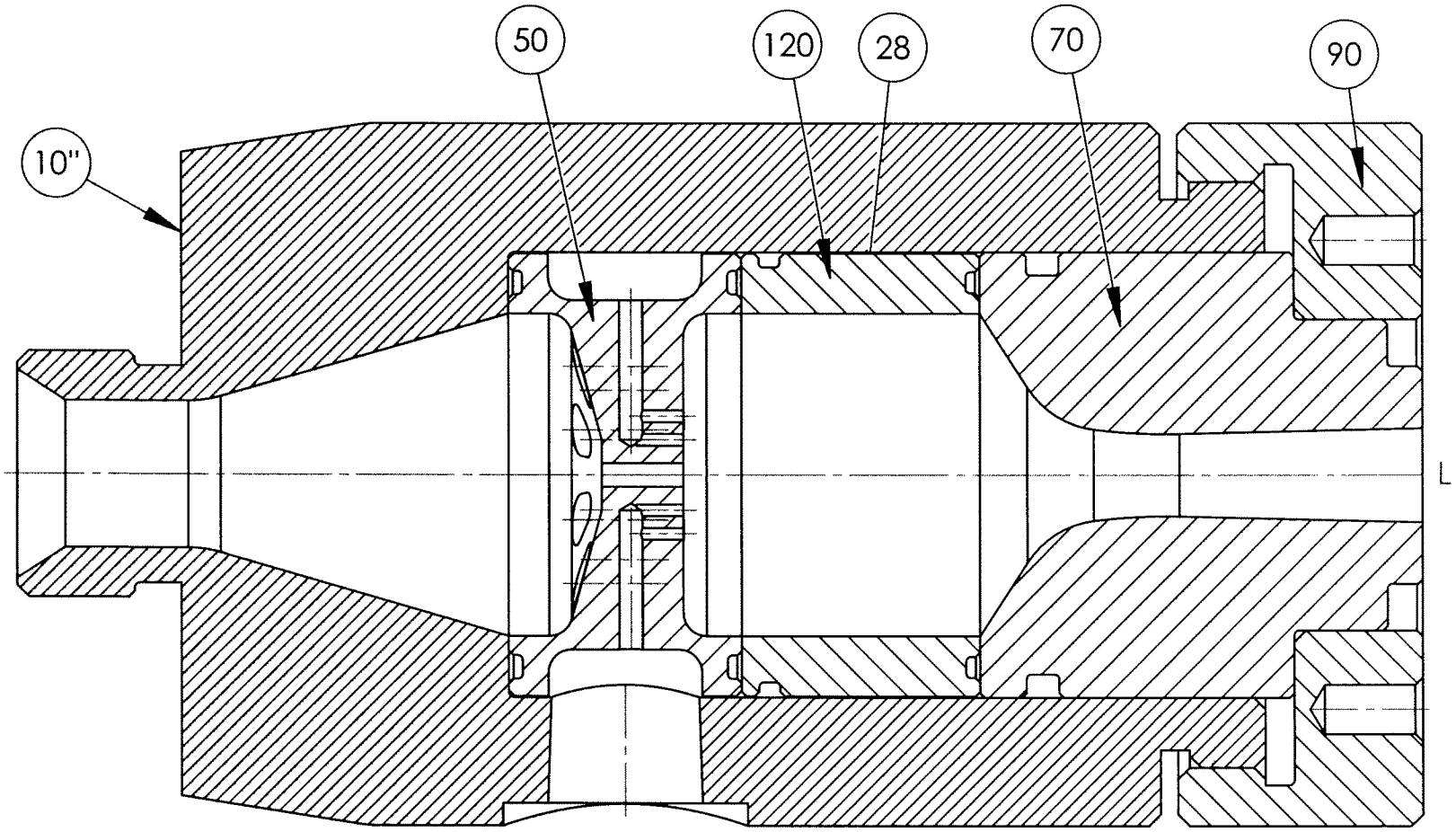
FIG. 7 is a longitudinal section through a third embodiment of a mist generating apparatus.
Figure 8:
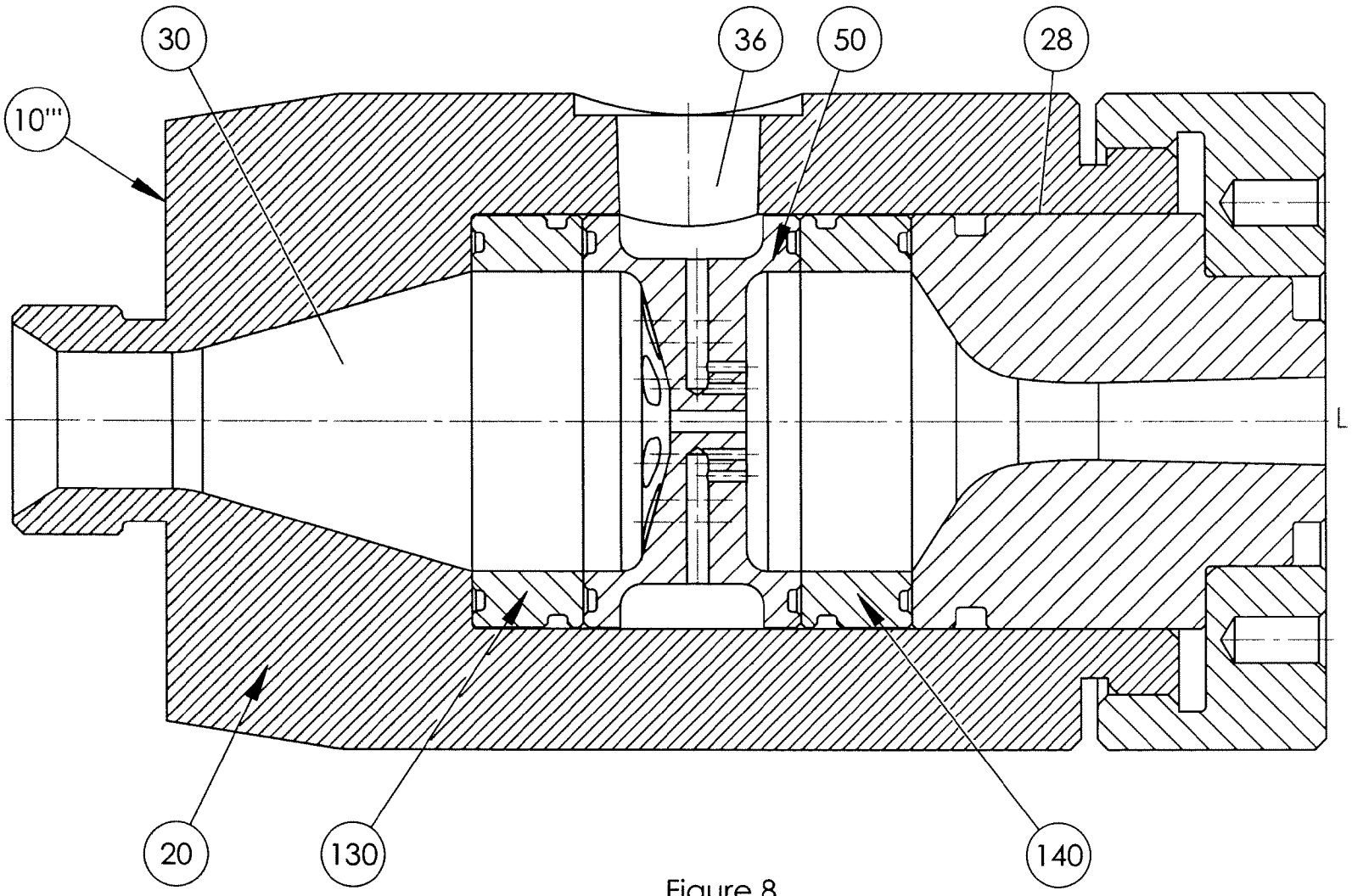
FIG. 8 is a longitudinal section through a fourth embodiment of a mist generating apparatus.

FIGS. 6-8 show alternative embodiments of a mist generating apparatus. Each of these alternative embodiments utilises the first and second inserts 50,70 and the locking member 90 as already described above with reference to FIGS. 2-4. The features of these components have therefore been assigned the same reference numbers and will not be described again in connection with these alternative embodiments.

Where these alternative embodiments differ from the first embodiment described above is that they are provided with a third insert which is to be located in the compartment 28 of the body 20 along with the first and second inserts 50,70.

In the second embodiment of the apparatus 10' shown in FIG. 6, a third insert 110 is inserted into the compartment 28 prior to the insertion of the first and second inserts 50,70. The third insert 110 is tubular and has an outer diameter which is selected so as to provide a close, sealing fit between the tubular member 110 and the inner surface of the compartment 28. To assist with the sealing fit, a first end 112 of the third insert 110 is provided with a first circumferential groove 114 in which an O-ring seal 116 is located. Thus, when the third insert 110 is correctly positioned in the compartment 28, the first end 112 and seal 116 abut against the outlet 34 of the transport fluid supply conduit 30. A second circumferential groove 118 is provided in the outer surface of the third insert 110 adjacent a second end 113 of the insert 110. A further O-ring seal 117 is provided in the second groove 118 to aid the sealing of the outer surface of the third insert 110 to the inner surface of the compartment 28.

Certain modifications may be made to the body 20 in order to incorporate the third insert 110. The axial length of the compartment 28 may be increased so that all three inserts 50,70,110 can be located therein. Alternatively, the axial length of the first and second inserts 50,70 may be reduced in order that all three inserts may be accommodated. Another modification that may be required is to form the working fluid supply conduit 36 at a different axial position on the body 20. This will be necessary if the third insert 110 is located upstream of the first insert 50, as the first insert 50 will then be further along the compartment 28 than in the first embodiment. As seen in FIG. 6, the supply conduit 36 has been repositioned so that the first insert 50 still receives the working fluid via the supply conduit 36 and the channel 64.

The second embodiment of the apparatus 10' is assembled and operates in substantially the same manner as the first embodiment. However, the presence of the tubular third insert 110 between the transport fluid supply conduit 30 and the first insert 50 effectively increases the axial length of the transport fluid supply conduit 30.

The third and fourth embodiments of the apparatus 10", 10''' are shown in FIGS. 7 and 8. These embodiments are variations on the second embodiment in that they are also provided with supplementary inserts. The third embodiment shown in FIG. 7 has a third insert 120 substantially identical to that used in the second embodiment. However, in the third embodiment the third insert 120 is positioned in the compartment 28 such that it is sandwiched between the first insert 50 and the second insert 70. As with the second embodiment, the axial length of the compartment 28 in the body 20 may be extended to accommodate all three inserts. The third embodiment is assembled and operates in substantially the same manner as the first and second embodiments, but the presence of the tubular third insert 120 between the first and second inserts 50,70 effectively increases the axial length of the mixing chamber downstream of the first insert 50.

The fourth embodiment of the apparatus 10''' shown in FIG. 8 effectively combines the arrangements used in the second and third embodiments of the apparatus. This results in third and fourth inserts 130,140 being located in the compartment 28 upstream and downstream of the first insert 50, respectively. The third and fourth inserts 130,140 are tubular and substantially identical to the third inserts used in the second and third embodiments. The only difference envisaged between the inserts of this embodiment and the third inserts of the preceding embodiments is that they may be of shorter axial length so that all four inserts fit in the compartment 28 of the body 20. Again, the body 20 may be modified to vary the axial length of the compartment 28 and/or axial location of the working fluid supply conduit 36 according to the positions of the inserts.

The fourth embodiment is assembled and operates in substantially the same manner as the preceding embodiments, but the presence of both third and fourth tubular inserts 130, 140 either side of the first insert 50 effectively increases the axial length of both the transport fluid supply conduit 30 and the mixing chamber downstream of the first insert 50.

Using these supplementary third, or third and fourth, inserts of varying lengths reduces the manufacturing complexity of the apparatus. For instance different sizes and lengths of nozzle, or first insert, could be installed into the apparatus body along with one or more supplementary inserts without the need to modify the length of the body or the locking member, or to change the pipework connecting it to a working fluid source. Additionally, changing the axial length of the mixing chamber(s) may alter the turbulence in these regions and alter the first stage of the atomisation mechanism employed by the present invention.

Figure 9:
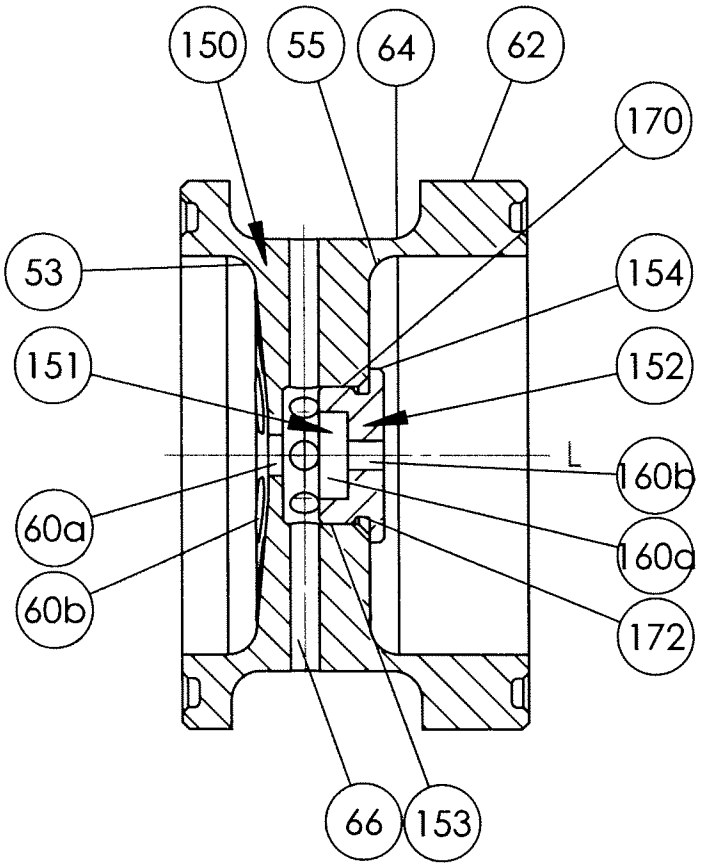
FIG. 9 is a longitudinal section through a modified first insert of a mist generating apparatus.

FIG. 9 shows a section view of a modified first insert 150, which could be utilised in any of the preceding embodiments of the mist generating apparatus. The basic configuration of the modified first insert 150 is substantially the same as the first insert 50 of FIG. 2, with first and second cavities 53,55 being fluidly connected with one another by a plurality of first passages, or transport fluid passages, 60*a*,60*b*. An inner first passage 60*a* is located in the centre of the modified insert 150 such that it is co-axial with a longitudinal axis L shared by the insert 150 and the assembled apparatus in which it will be located. The outer first passages 60*b* are circumferentially spaced about, and substantially parallel with, the inner first passage 60*a* and the longitudinal axis L.

The modified insert 150 also has an outer circumferential surface 62 in which a channel 64 is formed. The channel 64 extends around the entire circumference of the insert 50. Extending radially inwards through the insert 50 from the channel 64 are a plurality of working fluid supply conduits 66. The supply conduits 66 are substantially perpendicular to the first passages 60*a*,60*b* and longitudinal axis L. The supply conduits 66 extend radially inwards through the insert 50 in the circumferential spaces provided between the outer first passages 60*b*. Where the modified insert 150 differs from the original first insert is that the second, or working fluid passages, have been replaced with a central third cavity 170. The third cavity 170 is co-axial with the longitudinal axis L and the inner first passage 60*a*. The third cavity 170 is formed such that it is in fluid communication with the inner first passage 60*a*, each of the supply conduits 66 and the second cavity 55. The third cavity 170 has an internal diameter which is larger than that of the inner first passage 60*a* but smaller than that of the second cavity 55. A circumferential lip 172 projects radially inwards from the wall of the third cavity 170 at the point where the third cavity opens into the second cavity 55.

A substantially circular plug 152 is provided for insertion into the third cavity 170 from the second cavity 55. The plug 152 has a plug body 153 whose external diameter is greater than the internal diameter of the lip 172. Therefore when the plug 152 is inserted into the third cavity 170 the plug body 153 pushes past the lip 172 and there is a snap-fit between the plug body 153 and the lip 172. The lip 172 thus prevents the plug 152 from coming out of the cavity 170. A flange portion 154 projects radially outwards from the plug body 153. The flange portion 154 has a larger diameter than the internal diameter of the third cavity 170 so as to limit the extent to which the plug 152 may enter the third cavity 170.

A central passage extends longitudinally through the plug 152. The central passage comprises a large diameter portion 160*a* and a small diameter portion 160*b*. When the plug 152 is in position within the modified insert 150, the third cavity 170 and the large diameter portion 160*a* of the central passage define a first stage mixing chamber 151. The first stage mixing chamber 151 will receive transport fluid from the inner first passage 60*a* and working fluid from the supply conduits 66. The small diameter portion 160*b* of the central passage allows the transport and working fluids received by the first stage mixing chamber 151 to pass into the main mixing chamber partially defined by the second cavity 55.

Transport fluid passing from the relatively small diameter inner first passage 60*a* into the larger diameter first stage mixing chamber 151 will expand and create a turbulent flow within the first stage mixing chamber. Working fluid entering the first stage mixing chamber 151 will encounter this turbulence and the frictional forces generated between the two fluids will lead to the atomisation of at least some of the working fluid. The flow of transport and working fluids will then pass through the small diameter portion 160*a* of the central passage into the main mixing chamber downstream. Thus, the modified first insert 150 provides an initial mixing stage for the transport fluid and working fluid before the main mixing stage which takes place downstream of the first insert, as described above. This initial mixing stage enhances the atomisation mechanisms occurring upstream of the nozzle by providing a two stage initial atomisation process of turbulent mixing and droplet breakup.

Providing a plurality of transport fluid passages allows the formation of a number of separate transport fluid flow paths into the mixing chamber. When these various transport fluid flows contact one another in the mixing chamber, a greater amount of turbulence is created in the mixing chamber. The enhanced turbulence ensures that the atomised droplets are evenly distributed throughout the mixing chamber. Additionally, the high levels of turbulence mean that if droplets collide with one another, or a surface, the generated internal stresses will be high, such that they are more likely to exceed the surface tension forces. This means that collisions are more likely to cause droplet breakup rather than coalescence. Arranging the various passages so that the transport fluid outlets surround the working fluid outlets, whether in the radial or circumferential direction, achieves a more homogenous distribution of droplets in the mixing chamber and expansion section (i.e. post-throat portion) of the nozzle. This ensures that the third (expansion) stage of the atomisation process is as effective as possible.

When present, a plurality of working fluid passages allows a greater flowrate of working fluid to be atomised.

Positioning the working fluid passage outlets towards the outside of the mixing chamber can enhance atomisation by optimising a wall stripping mechanism. With wall stripping, a film of working fluid which attaches itself to the inner surface of the mixing chamber will be gradually atomised as the transport fluid flow strips droplets from the film of working fluid. Providing a longer mixing chamber, as in the case of the third embodiment using a third insert, can enhance the wall stripping process, as the surface area over which the film of working fluid extends is increased.

The transport fluid supply conduit, the transport fluid passages and the nozzle passage are relatively wide and have minimal restrictions therein. As a result, a particulate-laden fluid can be used as the transport fluid without any concerns that the relevant passages will become blocked by the particulate matter contained in the transport fluid.

By forming the apparatus from a small number of components, the present invention provides a simplified manufacturing process. The individual components themselves are of a reduced complexity compared with existing apparatus, which is advantageous in terms of production costs. Additionally, as the inserts are fitted in the body and held in place by the locking member, the machining tolerances required when manufacturing the components can be reduced.

The outer first fluid passages need not be parallel to the longitudinal axis L. Instead the outer first fluid passages may be angled relative to the longitudinal axis L. In other words, the inlet and outlet of each outer first fluid passage may be at different radial positions relative to the axis L. Furthermore, the first fluid passages need not be of substantially constant diameter. The first fluid passages may have a portion which is of reduced diameter and/or a portion which is of increased diameter. As well as a generally teardrop cross section, the first fluid passages may alternatively have a substantially circular cross section, or they may have an elliptical cross section.

There may be more than two sets of first fluid passages. For example, a third set of first fluid passages may extend circumferentially about the inner and outer first fluid passages, at a greater radial distance from the axis L than those inner and outer first fluid passages.

Whilst preferable, the second fluid passages need not be located radially between the inner and outer first fluid passages. The second fluid passages could be located radially and circumferentially so that they are between pairs of the outer first fluid passages, so that the second fluid passages and outer first fluid passages alternate in the circumferential direction about the longitudinal axis L. In other words, the outlets of the second fluid passages are surrounded in the circumferential direction by the outlets of the first fluid passages.

The second fluid passages may also be fluidly connected with the outer first fluid passages in the first insert such that atomisation commences within the second fluid passages upstream of the mixing chamber.

Each of the second fluid passages may include a turbulence-generation component therein. The component may take the form of a tapered edge inside the passage, for example.

The second fluid passages need not be parallel to the longitudinal axis L. Instead the second fluid passages may be angled relative to the longitudinal axis L. In other words, the inlet and outlet of each second fluid passage may be at different radial positions relative to the axis L. Furthermore, the second fluid passages need not be of substantially constant diameter. The second fluid passages may have a portion which is of reduced diameter and/or a portion which is of increased diameter. The second fluid passages may have a substantially circular cross section, or alternatively they may have an elliptical cross section.

There may be more than two sets of second fluid passages. For example, a third set of second fluid passages may extend circumferentially about the inner and outer sets of second fluid passages, at a greater radial distance from the axis L than the inner and outer sets of second fluid passages.

Although the preferred embodiment of the apparatus described above has only one working fluid inlet in the body, there may be a plurality of working fluid inlets circumferentially spaced about the side wall of the body. Each of the working fluid inlets may be in fluid communication with the channel extending about the circumference of the first insert.

The plug utilised in the modified first insert shown in FIG. 9 may be provided with a plurality of supplementary passages connecting the first stage mixing chamber and the second cavity. These supplementary passages may be circumferentially spaced around the small diameter portion of the central passage. The supplementary passages may be at more than one radial position relative to the small diameter portion of the central passage.

In the embodiments employing third, or third and fourth, inserts a number of working fluid supply conduits may be supplied at various positions along the body. These supply conduits may be capped off or connected to the working fluid supply as necessary, depending on the axial location along the chamber of the first insert due to the presence of these supplementary inserts. Alternatively, the first and third inserts may be shaped such that the circumferential supply channel of the first insert extends longitudinally and continuously over the front portion of the first insert as well as a portion of the third insert. This would mean that a single working fluid supply conduit could be provided in the body, but that this conduit could still provide working fluid to the first insert when it is axially spaced from the conduit by the presence of the third insert.

A further modification to the apparatus would be to turn the first insert around, such that the second fluid passages face upstream towards the supply of the transport fluid. In this case, working fluid and transport fluid flowing in opposite directions would come into contact with one another in a mixing chamber defined between the body and the first insert. The working fluid would be atomised in the mixing chamber and then the transport fluid would carry the dispersed working fluid downstream to the nozzle by way of the first fluid passages in the first insert. The third tubular insert may also be deployed between the body and first insert in this modified version of the apparatus, thereby increasing the size of the mixing chamber defined between the body and first insert. Extending the mixing chamber in this way can enhance the turbulent mixing therein.

In its simplest form, the apparatus of the present invention comprises a plurality of transport fluid passages and at least one working fluid passage which open into a mixing chamber and a nozzle downstream of the mixing chamber. This arrangement alone can provide one or more of the benefits listed elsewhere in this specification. Therefore, whilst the description of the preferred embodiment of the present invention above describes various groups of passages and their preferred radial and circumferential positions relative to one another, it should be understood that these combinations are not essential for the successful operation of the invention. Whilst the preferred embodiment of the present invention described above comprises a plurality of working fluid passages, the present invention is not limited to a number of working fluid passages. The present invention will provide one or more of the advantages listed herein so long as it has one or more working fluid passages. Furthermore, whilst the preferred embodiment has an inner transport fluid passage which is co-axial with the longitudinal axis L, the present invention is not limited to the inclusion of this inner transport fluid passage. The present invention will also be effective with transport fluid passages which are only circumferentially spaced around the longitudinal axis L.

As already stated in the detailed description of the present invention, the transport fluid is not limited to air. Other examples of suitable fluids are nitrogen, helium and steam. Similarly, water is not the only suitable working fluid which can be used with the invention. Other fluids which include additives such as decontaminants, surfactants or suppressants are also suitable for use as the working fluid.

These and other modifications and improvements may be incorporated without departing from the scope of the invention.

The invention claimed is:

1. An apparatus for generating a mist, comprising: a plurality of working fluid supply conduits, each conduit having an inlet in fluid communication with a supply of working fluid and an outlet; a first mixing chamber being in fluid communication with the outlets of the working fluid supply conduits; a plurality of transport fluid passages, each transport fluid passage having an inlet adapted to receive a supply of transport fluid and an outlet in fluid communication with the mixing chamber; and wherein the plurality of transport fluid passages comprise an inner transport passage co-axial with the longitudinal axis of the apparatus, and a plurality of outer transport fluid passages circumferentially spaced about the inner transport fluid passage;

a plurality of working fluid passages, each having an inlet in fluid communication with the working fluid supply conduits and an outlet in fluid communication with the mixing chamber, and each working fluid passage having a diameter which is less than that of each of the supply conduits; and wherein at least one of the transport fluid passage outlets is positioned a shorter radial distance from the longitudinal axis than one of the working fluid passage outlets; and a nozzle having an inlet in fluid communication with the mixing chamber, an outlet, and a throat portion intermediate the nozzle inlet and outlet, the throat portion having a cross sectional area which is less than that of either the nozzle inlet or the nozzle outlet; wherein the working fluid passages are circumferentially spaced about an inner transport fluid passage, and radially positioned between the inner transport fluid passage and the outer transport fluid passage.

2. The apparatus of claim 1, wherein the plurality of working fluid passages comprise inner and outer working fluid passages, wherein the groups of inner and outer working fluid passages are both circumferentially spaced about the inner transport fluid passage, the outer working fluid passages being a greater radial distance from the inner transport fluid passage than the inner working fluid passages.

3. The apparatus of claim 1, further comprising a second mixing chamber intermediate the working fluid supply conduit and the first mixing chamber, wherein at least one of the transport fluid passages is in fluid communication with the second mixing chamber whilst the remainder of the transport fluid passages are in fluid communication with the first mixing chamber.

4. The apparatus of claim 3, further comprising a communicating passageway between the first and second mixing chambers, the passageway having a cross sectional area which is less than that of either mixing chamber.

5. A method of generating a mist, comprising the steps of: supplying a pressurised working fluid to a plurality of working fluid supply conduits, each conduit having an inlet in fluid communication with a supply of working fluid and an outlet; introducing a supply of transport fluid through a plurality of transport fluid passages into a first mixing chamber downstream of the working fluid supply conduits, each transport fluid passage having an inlet adapted to receive the supply of transport fluid and an outlet in fluid communication with the mixing chamber, and wherein the plurality of transport fluid passages comprise an inner transport fluid passage co-axial with the longitudinal axis of the apparatus, and a plurality of outer transport fluid passages circumferentially spaced about the inner transport fluid passage; and wherein at least one of the transport fluid passage outlets is positioned a shorter radial distance from the longitudinal axis than one of the working fluid passage outlets;

directing the working fluid through a plurality of working fluid passages circumferentially spaced about the inner transport fluid passage and radially positioned between the inner transport fluid passage and the outer fluid transport passages, wherein each working fluid passage has an inlet in fluid communication with the working fluid supply conduits, an outlet in fluid communication with the mixing chamber, and a diameter which is less than that of each of the supply conduits; atomising the working fluid by injecting a stream of working fluid from the working fluid supply passages into the first mixing chamber to form a dispersed phase of working fluid droplets; directing the transport fluid and dispersed phase of working fluid from the first mixing chamber through a nozzle having a nozzle inlet, a nozzle throat and a nozzle outlet, wherein the nozzle throat has a reduced cross sectional area which is less than that of both the nozzle inlet and the nozzle outlet; and spraying the transport fluid and dispersed phase of working fluid from a nozzle outlet.

* * * * *